US008708305B2

(12) United States Patent
McGreevy et al.

(10) Patent No.: US 8,708,305 B2
(45) Date of Patent: Apr. 29, 2014

(54) ADHESIVELY MOUNTED ARTICLE SUPPORT ASSEMBLY WITH EXPOSED PULL TAB

(75) Inventors: Sean C. McGreevy, St. Paul, MN (US); Craig D. Thompson, Inver Grove Heights, MN (US); Jameel R. Qiblawi, Mendota Heights, MN (US); Berlin Fu, Taoyuan County (TW); Ho H. Kun, New Taipei (TW)

(73) Assignee: 3M Innovative Properties Company, St. Paul, MN (US)

( * ) Notice: Subject to any disclaimer, the term of this patent is extended or adjusted under 35 U.S.C. 154(b) by 332 days.

(21) Appl. No.: 12/849,990

(22) Filed: Aug. 4, 2010

(65) Prior Publication Data

US 2012/0032043 A1 Feb. 9, 2012

(51) Int. Cl.
*A47G 29/00* (2006.01)

(52) U.S. Cl.
USPC ..... 248/683; 248/205.3

(58) Field of Classification Search
USPC ..... 248/683, 467, 309.1, 317, 205.3; 40/594; 156/247, 249; 428/40.1, 41.7, 428/41.8, 41.9, 42.1, 42.2, 42.3
See application file for complete search history.

(56) References Cited

U.S. PATENT DOCUMENTS

| | | | | |
|---|---|---|---|---|
| 4,024,312 | A | 5/1977 | Korpman | |
| 5,409,189 | A | 4/1995 | Luhmann | |
| 5,507,464 | A | 4/1996 | Hamerski | |
| 5,516,581 | A | 5/1996 | Kreckel | |
| 5,925,459 | A | 7/1999 | Zimmerman | |
| 5,967,474 | A * | 10/1999 | doCanto et al. | 248/205.3 |
| 5,989,708 | A | 11/1999 | Kreckel | |
| 6,082,686 | A | 7/2000 | Schumann | |
| 6,106,937 | A | 8/2000 | Hamerski | |
| 6,131,864 | A | 10/2000 | Schumann | |
| 6,162,534 | A * | 12/2000 | Hamerski | 428/354 |
| 6,231,962 | B1 | 5/2001 | Bries | |
| 6,499,707 | B2 * | 12/2002 | Hamerski et al. | 248/205.3 |
| 6,811,126 | B2 | 11/2004 | Johansson | |
| 7,028,958 | B2 | 4/2006 | Pitzen | |
| 7,276,272 | B2 * | 10/2007 | Mizuno et al. | 428/40.1 |
| 7,540,456 | B2 | 6/2009 | Thompson | |
| 2001/0028022 | A1 * | 10/2001 | Hamerski et al. | 248/205.3 |
| 2004/0123503 | A1 * | 7/2004 | Pitzen | 40/594 |
| 2004/0188580 | A1 * | 9/2004 | Ryu et al. | 248/304 |
| 2007/0257165 | A1 * | 11/2007 | Newbould et al. | 248/205.3 |
| 2010/0096531 | A1 * | 4/2010 | Morrison | 248/467 |

FOREIGN PATENT DOCUMENTS

| | | |
|---|---|---|
| DE | 33 31 016 | 10/1984 |
| DE | 19955177 A1 | 5/2001 |

OTHER PUBLICATIONS

International Search Report for PCT/US2011/046553 prepared by the Korean Intellectual Property Office, mailed Apr. 6, 2012.
Supplementary European Search Report for EP application 11815310.5, dated Jan. 3, 2014.

* cited by examiner

*Primary Examiner* — Alfred J Wujciak
(74) *Attorney, Agent, or Firm* — David B. Patchett

(57) ABSTRACT

An article support assembly includes a stretch releasable adhesive strip having an adhesive portion and a non-adhesive pull tab portion, and a unitary article support member arranged over at least a portion of the adhesive portion of the stretch releasable adhesive strip. The article support member and pull tab are configured so that when the article support member is mounted on a surface using the stretch releasable adhesive strip, the pull tab remains exposed but is visually inconspicuous.

6 Claims, 3 Drawing Sheets

ADHESIVELY MOUNTED ARTICLE SUPPORT ASSEMBLY WITH EXPOSED PULL TAB

BACKGROUND

The present invention relates generally to adhesively mounted articles, and more particularly, to articles mounted using stretch releasing adhesives having a non-adhesive pull tab.

Stretch releasing adhesives are high performance pressure-sensitive adhesives that combine strong holding power with clean removal and no surface damage. Stretch releasing adhesives are commonly provided in the form of strips that include an adhesive portion and a non-adhesive pull tab portion that is grasped and pulled by a user during the stretch removal process.

Stretch releasing adhesive strips are commonly used to removably adhesively mount a holding device, such as a hook, on a surface, such as a wall, window, cabinet, or the like. Such devices are generally designed to either conceal the non-adhesive pull tab or leave it exposed. Devices that leave the pull tab exposed allow a user to directly grasp the pull tab to stretch remove the adhesive strip from the holding device and the surface. Leaving the pull tab exposed, however, is often considered aesthetically undesirable. Examples of devices that leave the non-adhesive pull tab exposed are described in U.S. Pat. No. 5,409,189 (Luhmann), and U.S. Pat. No. 5,989,708 (Kreckel).

To conceal the pull tab, and thereby improve the overall visual appearance of devices mounted using stretch releasing adhesive strips, devices have been designed to completely overlay, and thereby conceal, the pull tab, and selectively allow access to the pull tab during the stretch removal process. Examples of holding devices that allow the non-adhesive pull tab to be selectively concealed are described in U.S. Pat. No. 5,507,464 (Hamerski et al.), U.S. Pat. No. 5,967,474 (doCanto et al.), U.S. Pat. No. 6,082,686 (Schumann), U.S. Pat. No. 6,131,864 (Schumann), U.S. Pat. No. 6,811,126 (Johansson, et al.), and U.S. Pat. No. 7,028,958 (Pitzen, et al.). Devices designed to conceal the pull tab, however, often include multiple parts that may be misplaced or damaged. In addition, the number of parts adds to the cost to produce the devices, and increases the complexity of using the devices. For example, end users who are not familiar with the operation of such devices may not recognize that the device is designed to selectively expose the pull tab.

SUMMARY

There remains a need for a stretch releasing adhesive article that is aesthetically pleasing, is inexpensive to produce, easy to use, and allows users to readily access the non-adhesive pull tab during the stretch removal process.

In one embodiment, the present invention provides an article support assembly including a stretch releasable adhesive strip having an adhesive portion and a non-adhesive pull tab portion and a unitary article support member including a back plate portion and an article support portion arranged over at least a portion of the adhesive portion of the stretch releasable adhesive strip. In one aspect, the non-adhesive pull tab portion of the stretch releasable adhesive strip and the back plate portion of the article support member combine to form an article support assembly having a generally symmetric curved profile.

In a specific embodiment, the profile of the article support assembly may be oval. In another embodiments, the perimeter of the back plate portion includes an arcuate region adjacent the pull tab portion, the pull tab portion includes a curved region adjacent the arcuate region of the back plate, and the arcuate region of the back plate includes a tangent that matches the tangent of an adjacent tangent of the pull tab portion.

In another embodiment, the adjacent edges of the back plate portion and the pull tab may form a smooth continuous curved profile. In another embodiment, the back plate may include a first end opposite the pull tab and a second end adjacent the pull tab, and the back plate first end may have a shape that generally corresponds to the shape of the pull tab. In one aspect, the first end of the back plate may be tapered and the pull tab may be tapered.

In another embodiment, the present invention provides an article support assembly including a unitary article support member including an asymmetric back plate portion and an article support portion, and a stretch releasable adhesive strip having an adhesive portion and a non-adhesive pull tab portion, wherein the non-adhesive pull tab portion is arranged to extend beyond the perimeter of the back plate, and further wherein the non-adhesive pull tab portion has a size and shape to provide the article support assembly with a symmetric profile.

In one embodiment, the back plate may have a first end having a shape and a second end having a shape that differs from the shape of the first end, and the shape of the pull tab may generally correspond to the shape of the back plate first end.

In another embodiment, the back plate may include parallel side edges and an arcuate end opposite the pull tab, and the end of the pull tab may have an arcuate shape that generally corresponds with the shape of the arcuate end of the back plate.

In another embodiment, the back plate may include parallel side edges and a triangular end opposite the pull tab, and the end of the pull tab may have a triangular shape that generally corresponds with the shape of the triangular end of the back plate. In yet another embodiment, the second end of the back plate may be tapered, and the pull tab may be tapered.

In another embodiment, the present invention provides an article support assembly including a stretch releasable adhesive strip having an adhesive portion and a non-adhesive pull tab portion, and a unitary article support member including a back plate portion and an article support portion arranged over the adhesive portion of the stretch releasable adhesive strip, wherein the back plate includes a cutout region, wherein at least a portion of the pull tab portion is arranged within the cutout region, and wherein the stretch releasable adhesive strip and the article support member combine to form an article support assembly having a generally symmetric profile.

In one embodiment, the configuration of the pull tab portion may generally correspond to the configuration of the cut out region. In another embodiment, the cutout region may be concave. In another embodiment, the cutout region may be provided in the shape of a parallelogram.

In addition, various embodiments of the article support assembly described herein may consist of a stretch releasable adhesive strip having an adhesive portion and a non-adhesive pull tab portion and a unitary article support member including a back plate portion and an article support portion arranged over at least a portion of the adhesive portion of the stretch releasable adhesive strip, wherein the article support member and pull tab are configured so that when the article support member is mounted on a surface using the stretch releasable adhesive strip, the pull tab remains exposed but is visually inconspicuous.

In any of the embodiments described herein, the article support member and the pull tab may have the same surface finish or texture, such as a matte finish, to give the article support member and pull tab the same general appearance and thereby allow the appearance of the article support member and pull tab to blend together. In addition, the article support and the pull tab may be transparent.

Advantages of certain embodiments of the invention include that it allows the non-adhesive pull tab to remain exposed so it can be readily accessed by a user, that it has a visually pleasing appearance in which the exposed pull tab blends in with the overall appearance of the article support member, and that the article support member has a unitary or one-piece construction that is easy and inexpensive to make and provides an intuitive design that is easy to use.

BRIEF DESCRIPTION OF THE DRAWINGS

The present invention will be further described with reference to the accompanying drawings, in which.

DETAILED DESCRIPTION

Figure 1:
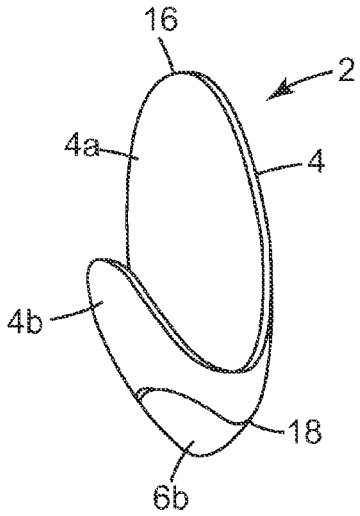
FIG. 1 is a perspective view of an article support assembly according to the invention.
Figure 2:
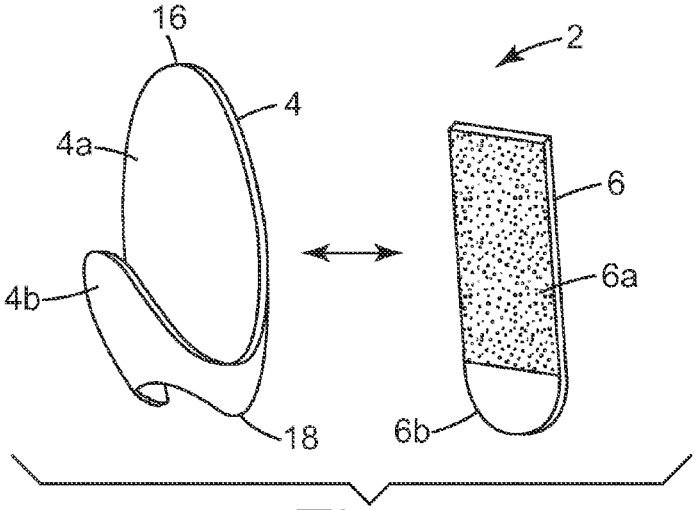
FIG. 2 is an exploded perspective view of the article support assembly of FIG. 1.
Figure 3:
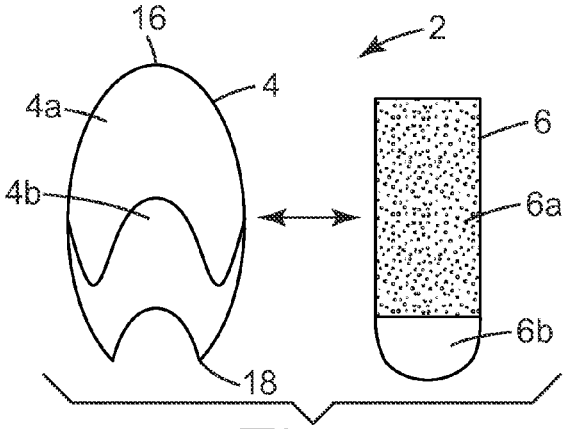
FIG. 3 is an exploded plan view of the article support assembly of FIG. 1.

Throughout the description and the accompanying figures functionally similar features are referred to with like reference numerals incremented by 100. Referring to the drawings, FIGS. 1-4 show an article support assembly 2 including a unitary (i.e. one-piece) article support member 4 and a stretch releasable adhesive strip 6 that serves to removably adhesively bond the article support member 4 to a substrate, such as a vertical wall surface, window, or cabinet (not shown). The unitary article support member 4 includes a back plate portion 4*a* and an article support portion 4*b*. The adhesive strip 6 includes an adhesive portion 6*a* and a non-adhesive pull tab portion 6*b*.

The stretch releasable adhesive strip 6 may be any conventionally known stretch releasable adhesive including a pressure sensitive adhesive tape having an elastic backing, a pressure sensitive adhesive tape with a highly extensible and substantially inelastic backing, or a solid, elastic pressure sensitive adhesive. Specific stretch releasable adhesive strips suitable for use in the various embodiments of the present invention include the pressure sensitive adhesives with elastic backings described in U.S. Pat. No. 4,024,312 (Korpman), the pressure sensitive adhesives with highly extensible and substantially inelastic backings described in U.S. Pat. No. 5,516,581 (Kreckel et al.) and Bries et al. (U.S. Pat. No. 6,231,962), and the solid, elastic pressure sensitive adhesive described in German Patent No. 33 31 016.

Suitable stretch releasable adhesive strips include the double-sided stretch releasable adhesive strips available from 3M Company, St. Paul, Minn. under the COMMAND trade designation. Commercially available COMMAND adhesive strips are currently manufactured as discrete strips with one end of the strip including a non-adhesive pull tab to facilitate stretching of the strip during the stretch removal process.

When the article support member 4 is mounted to a surface using the adhesive strip 6, the back plate portion 4*a* of the article support member 4 is arranged over at least a portion of the adhesive portion 6*a* of the stretch releasable adhesive strip 6, and at least a portion of the non-adhesive pull tab portion 6*b* of the adhesive strip 6 extends outwardly beyond the periphery of back plate portion 4*a*. In this manner, the pull tab portion 6*b* remains exposed and visible when the article support member 4 is mounted to a surface, thereby making the pull tab portion 6*b* readily accessible to an end user wishing to access the pull tab portion 6*b* during the stretch removal process, provided no item mounted on the article support member 4, such as a coat or hat, otherwise conceals the pull tab portion 6*b*.

In the illustrated embodiment, the article support portion 4*b* is depicted generically as a hook. It will be understood that the representation is considered illustrative of many functionalities that could alternatively be used. Other examples of article support portions include, for example, cup holders, clips, trays, soap dish holders, and toothbrush holders.

In accordance with one aspect of the article support assembly 2, the non-adhesive pull tab portion 6*b* of the stretch releasable adhesive strip 6, and the back plate portion 4*a* of the article support member 4 combine to form an article support assembly 2 that appears to have a generally symmetric and continuous curved profile. In the illustrated embodiment, the back plate portion 4*a* of the article support member 4 is not symmetric, but the pull tab portion 6*b* of the adhesive strip 6 has a size and shape that works with the asymmetric profile of the back plate portion 4*a* to form an overall profile that is visually pleasing and similar to what someone viewing the article support member 4 would expect to see. In this manner, the pull tab portion 6*b* blends in with the appearance of the back plate portion 4*a*, thereby making the pull tab portion 6*b*—which is exposed and readily accessible to an end user—less noticeable. The overall result is an article support assembly 2 that includes a simple one-piece article support member 4 that is easy to make, is user friendly because the pull tab is left exposed and is therefore readily accessible to the end user, and is visually pleasing.

Figure 4:
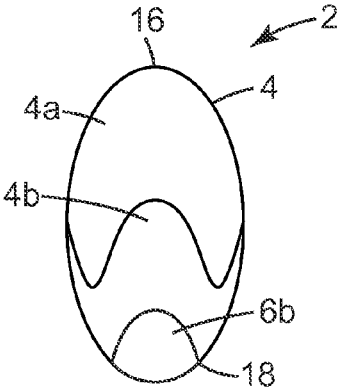
FIG. 4 is plan view of the article support assembly of FIG. 1.

Stated another way, the article support member 4 includes an asymmetric back plate portion 4*a* (shown most clearly in FIG. 3), and the adhesive strip 6 includes a non-adhesive pull tab portion 6*b* having a size and shape that combines with the asymmetric appearance of the back plate portion 4*a* to create a back plate member 4 having an overall visual presentation that appears to be symmetric (shown most clearly in FIG. 4). That is, the back plate portion 4*a* first end 16 has a shape that differs from the shape of the second end 18, and the configuration of the pull tab portion 6*b* generally matches, or corresponds to, the size and shape of the back plate first end 16, thereby creating an article support assembly 2 that appears to have a symmetric back plate that is visually pleasing, and tends to de-emphasize, or minimize, the appearance of the pull tab 6*b*.

In the embodiment illustrated in FIGS. 1-4, the profile of the article support member 4 is oval. Other curved geometric configurations, such as circles, are also contemplated. In specific embodiments, the profile of the back plate portion 4*a* may be tailored to suit the configuration of a pull tab portion 6*b* having a particular size and shape. In a specific aspect, it may be desirable for the back plate portion 4*a* and pull tab portion 6*b* to have adjacent edges that are contiguous and form a smooth continuous curved profile. That is, the adjacent edges of the back plate portion 4*a* and pull tab portion 6*b* form a smooth uninterrupted curve.

Figure 5:
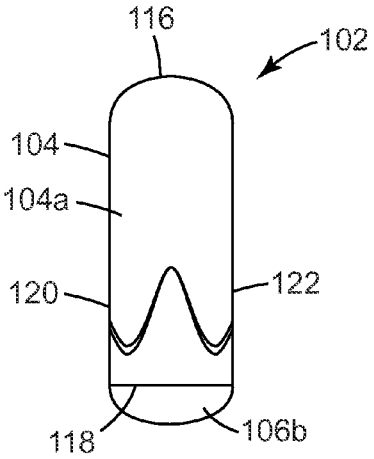
FIG. 5 is a plan view of a second embodiment of the invention.
Figure 6:
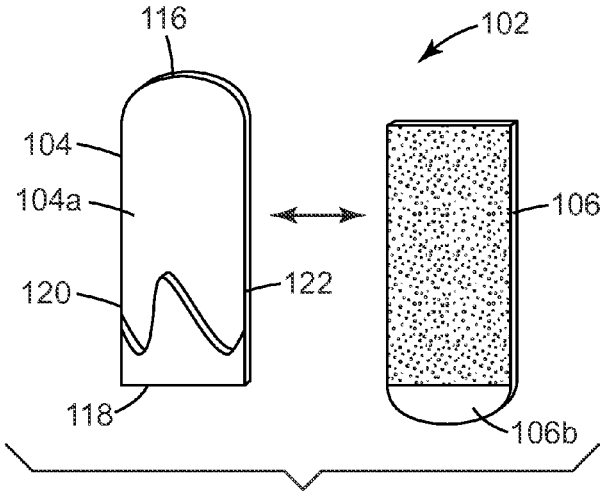
FIG. 6 is an exploded perspective view of the article support assembly of FIG. 5.

Referring to FIGS. 5 and 6, there is shown an article support assembly 102 consisting of a unitary article support member 104 and a stretch releasable adhesive strip 106. The article support assembly 102 is similar to the article support assembly 2 illustrated in FIGS. 1-4 except the profile of the article support member 104 is different. In the embodiment illustrated in FIGS. 5 and 6, the back plate portion 104*a* includes an arcuate first end 116, generally parallel side edges 120, 122 that extend away from the arcuate first end 116, and a second end 118 opposite the arcuate first end 116 that is a straight line perpendicular to the parallel side edges 120, 122. The pull tab portion 106*b* of the stretch releasable adhesive 106 includes an arcuate end that extends outwardly from behind the back plate portion 104*a* beyond the back plate portion 104*a* second end 118. To create symmetry, the pull tab portion 106*b* has a size and shape that generally matches the arcuate first end 116 of the back plate portion 104*a*.

Figure 7:
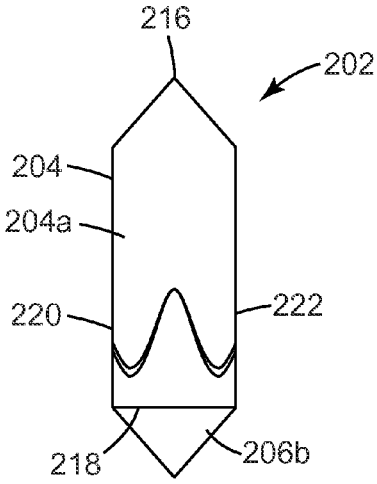
FIG. 7 is a plan view of a third embodiment of the invention.
Figure 8:
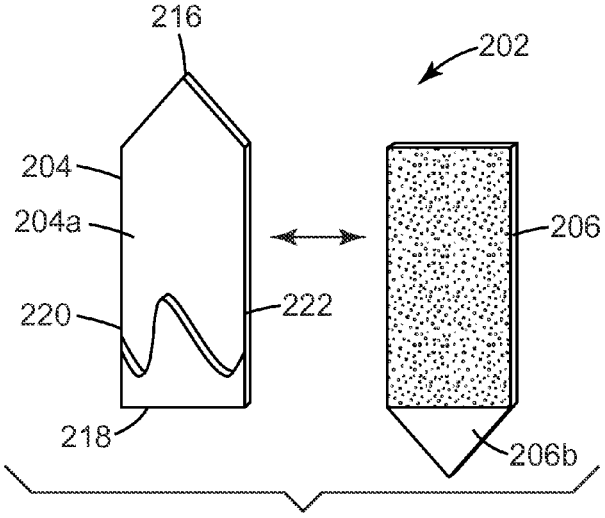
FIG. 8 is an exploded perspective view of the article support assembly of FIG. 7.

Referring now to FIGS. 7 and 8, there is shown an article support assembly 202 including a unitary article support member 204 and a stretch releasable adhesive strip 206 similar to the embodiment illustrated in FIGS. 5 and 6 expect the article support member 204 and stretch releasable adhesive 206 have opposed ends that are generally pointed or triangular rather than arcuate. More particularly, the article support member 204 includes a back plate portion 204*a* having a first end 216 that tapers to a point in the form of a triangle, generally parallel side edges 220, 222, and a straight second end 218. The stretch releasable adhesive 206 includes a pull tab portion 206*b* having a tapered end in the form of a triangle that extends outwardly from the back plate portion 204*a* beyond the second end 218 opposite from the triangular first end 216. That is, the base plate first end 216 and pull tab portion 206*b* have generally matching triangular ends. In this manner, the base plate portion 204*a* and pull tab portion 206*b* combine to create an article support assembly 202 that appears to be symmetric and is visually pleasing, which tends to minimize the prominence or appearance of the pull tab portion 206*b*.

Figure 9:
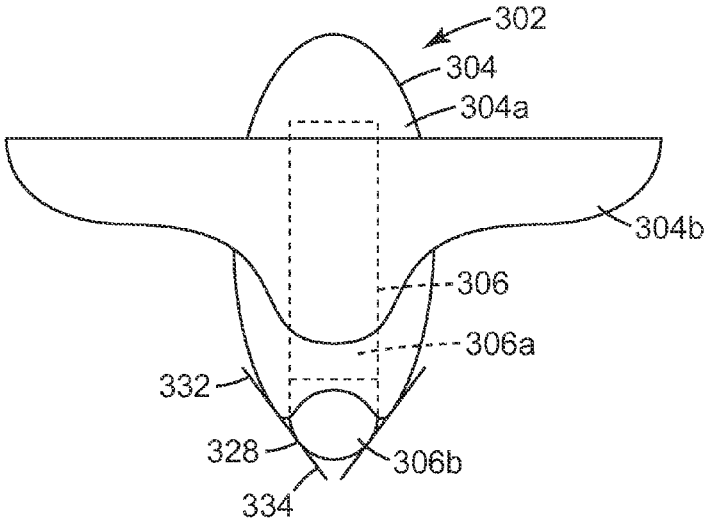
FIG. 9 is a plan view of a fourth embodiment of the invention.

Referring now to FIG. 9, there is shown another embodiment of an article support assembly 302 including a unitary article support member 304 comprising a back plate portion 304*a* and an article support portion 304*b*, and a stretch releasable adhesive strip 306 including an adhesive portion 306*a* and a non-adhesive pull tab portion 306*b*. In FIG. 9, the article support portion 304*b* is depicted as a horizontal shelf which will be understood to represent numerous functionalities including, for example, a soap holder or a toothbrush holder.

In accordance with one aspect of the illustrated embodiment, the perimeter of the back plate portion 304*a* includes an arcuate region 328 adjacent the pull tab portion 306*b*, and the pull tab portion 306*b* includes a curved region 330 adjacent the arcuate region of the back plate portion 304*a*. The arcuate region 328 of the back plate portion 304*a* includes a tangent 332 that is aligned with and matches the tangent of an adjacent tangent 334 of the curved region 330 of the pull tab portion 306*b*. Thus, in contrast to the embodiments illustrated in FIGS. 1-8, the perimeter of the back plate portion 304*a* need not be contiguous or precisely aligned with the perimeter of the pull tab portion 306*b* to achieve the desired visual appearance. Rather, in order to achieve the visual effect of making the pull tab portion 306*b* appear to blend into the overall appearance of the back plate portion 304*a*, and thereby complete the natural shape of the article support member 304 perceived by those viewing the article support assembly 302, it has been found that it is sufficient to have the tangent of the adjacent perimeter edges of the back plate portion 304*a* and pull tab portion 306*b* be aligned.

Figure 10:
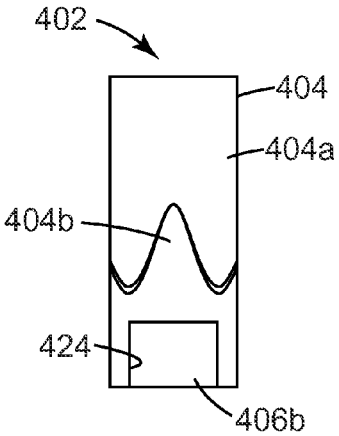
FIG. 10 is a plan view of a fifth embodiment of the invention.
Figure 11:
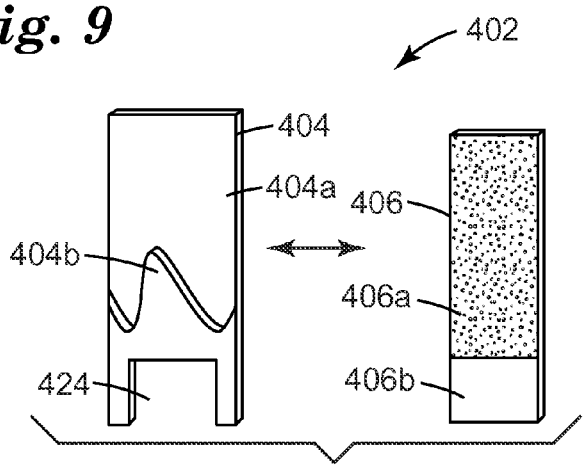
FIG. 11 is an exploded perspective view of the article support assembly of FIG. 10.

Referring now to FIGS. 10 and 11, there is shown another embodiment of an article support assembly 402 including a stretch releasable adhesive strip 406 having an adhesive portion 406*a* and a non-adhesive pull tab portion 406*b*, and a unitary article support member 404 including a back plate portion 404*a* and an article support 404*b*. The article support member 404 is arranged over the adhesive portion 406*a* of the stretch releasable adhesive strip 406.

In accordance with one aspect of the article support assembly 402, the back plate portion 404*a* of the article support member 404 includes a cutout region 424, which forms a discontinuity in the perimeter of what would otherwise be a rectangular back plate portion 404*a*, and the stretch releasable adhesive strip 406 includes a pull tab portion 406*b* that is sized to fill the cutout region 424. Because the adhesive strip 406 is arranged behind the article support member 404, the pull tab portion 406*b* may fill the cutout region 424 by having a perimeter that extends beyond the perimeter of the cutout region 424 or by having a size and shape that generally corresponds to the size and shape of the cutout region 424. In the embodiment illustrated in FIGS. 10 and 11, the cutout region 424 is rectangular, and the pull tab portion 406*b* is rectangular.

As illustrated in FIG. 10, when the article support member 404 is mounted on a surface using the stretch releasable adhesive strip 406, the pull tab portion 406*b* of the adhesive strip 406 is arranged within the cutout region 424. In this manner, the pull tab portion 406*b* "fills in" the cutout region 424, and thereby gives the back plate portion 404*a* a profile that appears complete and generally symmetric, which in the illustrated embodiment is rectangular. This allows the pull tab portion 406*b* of the adhesive strip 406 to remain exposed and, therefore, readily accessible to end users wishing to grasp and pull the pull tab portion 406*b* during the stretch removal process, but also serves to make the pull tab portion 406*b* less conspicuous.

Figure 12:
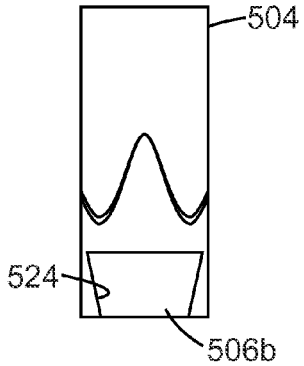
FIG. 12 is a plan view of a sixth embodiment of the invention.
Figure 13:
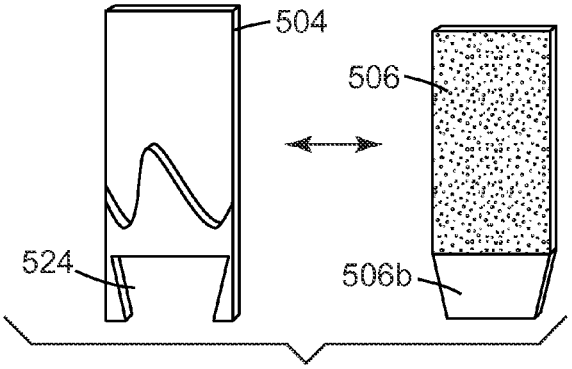
FIG. 13 is an exploded perspective view of the article support assembly of FIG. 12.

The particular configuration of the cutout region 424 and pull tab portion 406*b* is not significant to the invention hereof, so long as the pull tab portion 406*b* fills the cutout region 424, thereby giving the article support member 404 a symmetric appearance and minimizing the presence of the pull tab portion 406*b*, and also allowing the pull tab portion 406*b* to remain exposed and readily accessible to an end user wishing to grasp and pull the pull tab portion 406*b* during the stretch removal process. FIGS. 12 and 13, for example, show an article support member 504 having a generally trapezoidal cutout region 524. In the illustrated embodiment, the adhesive strip 506 is depicted as having a pull tab portion 506*b* with a trapezoidal shape that generally corresponds to the shape of the cutout region 524, but pull tabs having other shapes, such as a square or rectangle, may also be used to fill the trapezoidal cutout region 524.

An advantage of article support members having a cutout region is that the cut out region allows the use of adhesive strips that are narrower than the width of the associated article support member. That is, in the embodiments illustrated in FIGS. 5-8, in order to achieve the symmetric appearance, the article support member and the adhesive strip will generally have the same width. This is not necessarily the case if the article support member is provided with a cutout. In addition, article support members that do not include cutout regions are generally limited to use with a single adhesive strip, although the use of two adhesive strips with aligned and oppositely facing pull tab portions is also contemplated. An article support member with cutout regions, in contrast, may be designed to be used with an unlimited number of adhesive strips and still maintain the ability to create an article support member having a symmetric appearance and minimize the visual appearance of the pull tab portions. Another advantage of article support members having a cutout region is that the cutout region allows more of the pull tab to be remain exposed and accessible to the end user. This, in turn, provides more of the pull tab for a user to grasp during the stretch removal process.

In order to have the article support member and any exposed portion of the adhesive strip blend together inconspicuously, and thereby minimize the appearance of the pull tab portion, it is desirable to provide the article support member and any exposed portion of the adhesive strip, including the pull tab portion, with similar surface finishes (e.g. similar color, and similar surface texture). In this manner, the article support member and the exposed portion of the adhesive strip will present a consistent appearance. In certain end use applications, it may be desirable to minimize the appearance of both the article support member and the exposed portion of the adhesive strip. This may be accomplished, for example, by using article support members and adhesive strips that are clear or transparent.

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. An article support assembly, comprising:

(a) a stretch releasable adhesive strip having an adhesive portion and a non-adhesive pull tab portion; and (b) a unitary article support member arranged over at least a portion of the adhesive portion of the stretch releasable adhesive strip, the article support member including a back plate portion and an article support portion, the back plate portion defining opposing first and second major faces, wherein the stretch releasable adhesive strip is applied to the first major face and the article support portion projects from the second major face;

wherein the non-adhesive pull tab portion of the stretch releasable adhesive strip and the back plate portion of the article support member combine to form the article support assembly to have a generally symmetric curved profile, and wherein the article support assembly is configured such that when the article support member is mounted to a surface using the stretch releasable adhesive strip, at least a portion of the non-adhesive pull tab portion extends outwardly beyond a periphery of the back plate portion and adjacent edges of the back plate portion and the pull tab are contiguous and aligned, and thereby form a smooth continuous curved profile.

2. An article support assembly as defined in claim 1, wherein the profile of the article support assembly is oval.

3. An article support assembly as defined in claim 1, wherein the back plate includes a first end opposite the pull tab and a second end adjacent the pull tab, and further wherein the back plate first end has a shape that generally corresponds to the shape of the pull tab.

4. An article support assembly as defined in claim 1, wherein the article support and the pull tab are transparent.

5. An article support assembly, comprising:

(a) a stretch releasable adhesive strip having an adhesive portion and a non-adhesive pull tab portion; and (b) a unitary article support member including a back plate portion and an article support portion arranged over the adhesive portion of the stretch releasable adhesive strip;

wherein the back plate portion includes a cutout region, wherein at least a portion of the pull tab portion is arranged within the cutout region such that the portion of the pull tab portion is exposed and visible through the cutout region when the article support member is mounted to a surface by the stretch releasable adhesive strip, and wherein the stretch releasable adhesive strip and the article support member combine to form an article support assembly having a generally symmetric and continuous profile; wherein the article support portion is a hook projecting from the back plate portion; wherein a bottom edge of the back plate portion defines a perimeter of the cutout region, and further wherein projection of the hook terminates a tip spaced from the back plate portion and defines a lower edge opposite the tip, the lower edge being aligned with the bottom edge and having a shape corresponding with a shape of the bottom edge.

6. An article support assembly as defined in claim 5, wherein the cutout region is concave.

* * * * *